US006256024B1

(12) United States Patent
Maekawa

(10) Patent No.: US 6,256,024 B1
(45) Date of Patent: Jul. 3, 2001

(54) LIQUID CRYSTAL DISPLAY DEVICE

(75) Inventor: Toshikazu Maekawa, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/144,880

(22) Filed: Sep. 2, 1998

(30) Foreign Application Priority Data

Sep. 10, 1997 (JP) ..... 9-244924

(51) Int. Cl.[7] ..... G09G 5/00
(52) U.S. Cl. ..... 345/205
(58) Field of Search ..... 345/205, 204, 345/87, 88, 90, 98, 100

(56) References Cited

U.S. PATENT DOCUMENTS 5,414,443 * 5/1995 Kanatani et al. ..... 345/95
6,057,897 * 5/2000 Ichikawa et al. ..... 349/48
6,078,368 * 6/2000 Ichikawa et al. ..... 349/48

* cited by examiner

*Primary Examiner*—Richard Hjerpe
*Assistant Examiner*—Ronald Laneau
(74) *Attorney, Agent, or Firm*—Ronald P. Kananen; Rader, Fishman & Grauer

(57) ABSTRACT

A driving circuit combined type LCD which employs sampling system of analog video signals can not be applied to a medium to large sized LCD. To solve this problem, in an active matrix type LCD having a driving circuit unit which is capable of accepting digital signals having the signal level lower than the power source voltage of a horizontal driving circuit system and pixel unit formed combinedly, level shift circuits for converting the level of sampled digital signals having a small amplitude to digital signals having a voltage of 0 to the power source voltage Vd (for example, 12 V) are provided between sampling switches and latch circuits, thus the structure is capable of accepting digital signals having a small signal amplitude from the outside.

12 Claims, 4 Drawing Sheets

LIQUID CRYSTAL DISPLAY DEVICE

BACKGROUND OF THE INVENTION

1. Field of the Invention

This invention relates to a liquid crystal display (LCD) element, and more particularly relates to an active matrix type liquid crystal display element having a driving circuit unit and pixel unit formed combinedly that is capable of accepting a digital signal having a signal level lower than a power source voltage level of a horizontal driving circuit system.

2. Description of Related Art

Recently, the trend that LCD monitors separated from notebook type personal computers (referred to as personal computer hereinafter) being used as desktop type monitors has grown in response to the development of thin LCD monitors of reduced power consumption. The internal circuit of a personal computer is structured so that digital signals are processed. On the other hand, a CRT monitor is driven by analog signals, therefore the input output I/F (interface) is an analog I/F. However, because a LCD itself of a-Si uses mainly a source driver IC of a digital I/F, A/D conversion should be performed again somewhere, such conversion is very inefficient as a total system.

As for the state of the art of the driving circuit combined type LCD, while a sampling system of an analog video signal as shown in FIG. 5 is developed, a circuit having a digital I/F has not been realized. Herein, the system in accordance with the conventional example shown in FIG. 5 is described. Between a signal line 101 for transmission of a analog video signal and column lines 102-1 and **102-*n*, n transfer gates 103-1 to 103-*n*** are connected.

These transfer gates **103-*a* to 103-*n* are turned on (becomes conductive) at the rising edge of sampling pulses ϕ1, ϕ2, . . . , ϕn supplied successively from the H shift register 104 to sample an analog video signal, and supplies successively it to column lines 102-1 to 102-*n*. On the other hand, m row lines 105-1 to 105-*m* are driven successively by the V shift register 106**.

On respective intersection points of n column lines 102-1 to **102-*n* and m row lines 105-1 to 105-*m*, a thin film transistor (TFT) is provided. A source electrode of the thin film transistor 107 is connected to a column line 102-1 to 102-*n*, a gate electrode is connected to a row line 105-1 to 105-*n* respectively. A drain electrode of the thin film transistor 107** is connected to the transparent pixel electrode of pixels respectively arranged two dimensionally in the form of a matrix.

The system in accordance with the conventional example having the structure described herein above is advantageous to a small sized LCD of, for example, the view finder of a video camera or the light bulb of a projector in that a full color (full analog) display is realized with a relatively simple structure. However, application to a large sized or medium sized LCD results in a significant disadvantage.

(1) Use of a large sized LCD panel inevitably leads to use of large capacity video line and source line (column line), and a large power is consumed when signals are charged/discharged rapidly. Further, an analog buffer for driving such load results in very large EMI (Electromagnetic Interference) source, and set design is difficult.

(2) It is considered in order to cope with the problem (1) that an analog signal is divided into a multiplicity of divided signals and divided analog signals are supplied, however it is very difficult to eliminate the dispersion between channels of a multiplicity of divided analog signals. Further, the system will be a very complex and large system.

(3) Point-successive sampling timing and phase control of video signals are very difficult and the image quality inevitably becomes poor due to ghost.

For the reason described herein above, a large sized driving circuit combined LCD has not been realized up to today. In the field of a-Si (amorphous silicon) LCD, heretofore a method in which a silicone LSI is mounted near a panel using mounting method of TAB (Tape Automated Bonding) and a signal is supplied is employed. However, cost of silicon LSI and mounting cost of a silicon LSI results directly in the increased panel cost.

SUMMARY OF THE INVENTION

The present invention is accomplished in view of such problem, it is the object of the present invention to provide a driving circuit combined type liquid crystal display element which is capable of simplifying the interface with a personal computer and accepting digital input.

The liquid crystal display element is a liquid crystal display element having a driving circuit unit and pixel unit formed combinedly which is capable of accepting a digital signal input having a signal level lower than a power source voltage level of a horizontal driving circuit system provided with a pulse generation means for generating a sampling pulse which samples in time series an input digital signal correspondingly to a pixel, a sampling means for sampling the input digital signal in response to the sampling pulse, a level conversion means for converting a digital signal sampled by the sampling means to a signal having a signal level sufficient for subsequent processing, and a D/A conversion means for generating an analog signal based on a digital signal which was level converted by the level conversion means.

In the above-mentioned liquid crystal display element, the driving circuit unit including a system for sampling digital signals, a system for converting the level of sampled digital signals, and a system for converting digital signals to analog signals and the pixel unit are formed combinedly. The the level of input digital signals with a small amplitude is converted to the power source voltage level of the horizontal driving circuit, and the liquid display element is thereby rendered capable of accepting digital signal input having a small amplitude from the outside.

DETAILED DESCRIPTION OF THE PREFERRED EMBODIMENTS

Figure 1:
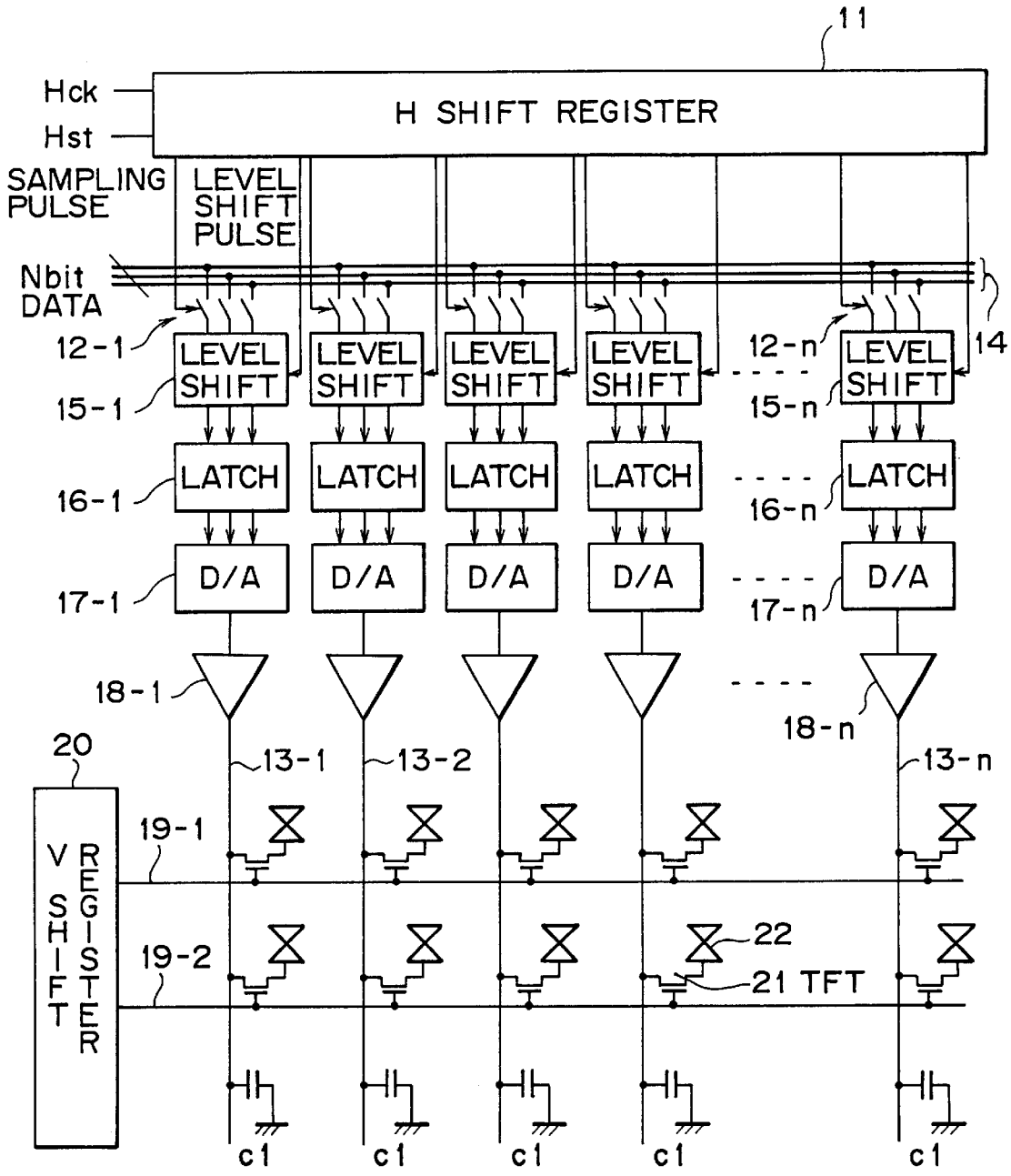
FIG. 1 is a schematic structural diagram for illustrating one embodiment of the present invention.

Embodiments of the present invention will be described in detail hereinafter with reference to the drawings. FIG. 1 is a schematic structural diagram for illustrating one embodiment of the present invention. An active matrix type LCD in accordance with the present invention has a structure in which a pixel unit and a driving circuit unit for receiving a digital signal having a signal level lower than that of a power source voltage (Vd) of the horizontal driving circuit system are formed combinedly on a glass substrate. A digital signal to be supplied is a N bit digital data (for color display, the number of total data lines is R, G, B×number of parallel processing)

In FIG. 1, a shift register 11, which functions as a horizontal scanning circuit generates a sampling pulse for sampling an input digital data in time series correspondingly to a pixel based on a horizontal start pulse Hst and horizontal clock pulse Hck, and generates a level shift pulse as described hereinafter. A group of sampling switches 12-1 to **12-*n* is provided correspondingly to n column lines 13-1 to 13-*n*, and samples a digital data on a data bus line 14 in response to the sampling pulse supplied successively from the H shift register 11**.

Digital data sampled successively by the group of sampling switches 12-1 to **12-*n* is supplied to level shift circuits 15-1 to 15-*n* which function as the level conversion means. The level shift circuits 15-1 to 15-*n* shifts the signal level of respective sampling data to a power source voltage (Vd) level of a horizontal driving circuit system based on a level shift pulse given by the H shift register 11. Respective sampling data shifted by level shift circuits 15-1 to 15-*n* are held during one horizontal time period by latch circuits 16-1 to 16-*n*.**

Respective latch data of latch circuits 16-1 to **16-*n* are converted to analog signals by D/A converters 17-1 to 17-*n*, and supplied to output buffers 18-1 to 18-*n*. Output buffers 18-1 to 18-*n* drives column lines 13-1 to 13-*n* based on analog signals given by D/A converters 17-1 to 17-*n*. On the other hand, m row lines 19-1 to 19-*m* are vertically scanned successively by a V shift register 20** which functions as a vertical scanning circuit and driven.

Respective intersection points of n column lines 13-1 to **13-*n* and m row lines 19-1 to 19-*m* have a thin film transistor (TFT) 21. A source electrode of a thin film transistor is connected to a column line 13-1 to 13-*n* and a gate electrode is connected to a row line 19-1 to 19-*m* respectively. A drain electrode of a thin film transistor 21 is connected to a transparent pixel electrode of liquid crystals (pixel) 22** which are arranged two dimensionally in the form of matrix.

The above-mentioned driving circuit system comprising the H shift register 11, the group of switches 12-1 to **12-*n*, level shift circuits 15-1 to 15-*n*, latch circuits 16-1 to 16-*n*, D/A converters 17-1 to 17-*n*, output buffers 18-1 to 18-*n*, and the V shift register 20** is formed on a polysilicone or crystal silicone transparent substrate or silicone substrate.

Figure 2:
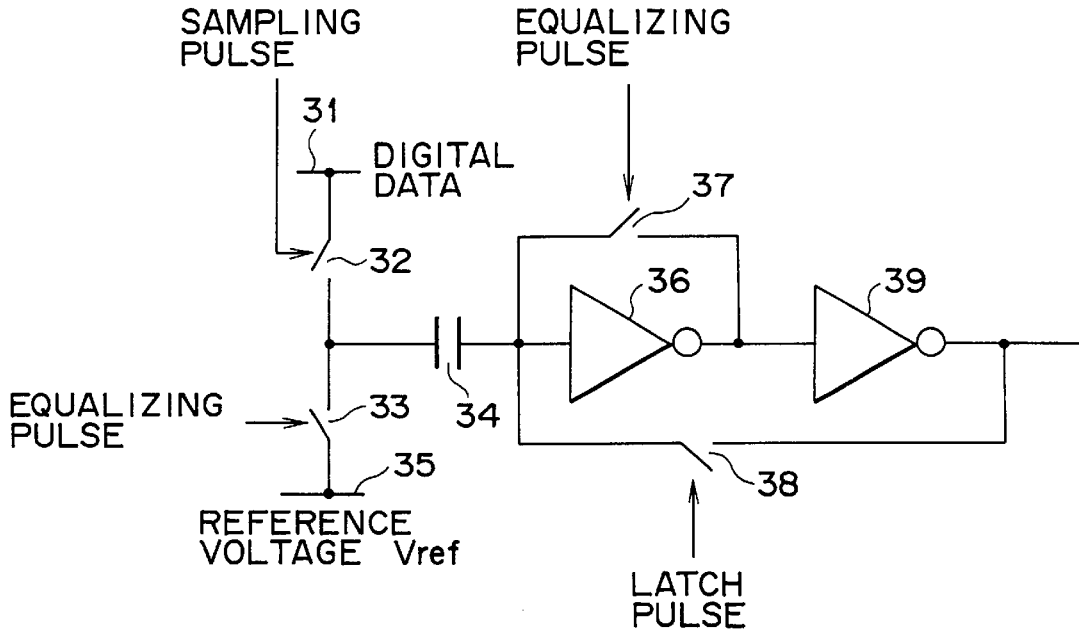
FIG. 2 is a circuit diagram for illustrating one example of a detailed circuit structure of a level shift circuit and a latch circuit.

FIG. 2 is a circuit diagram for illustrating one example of detailed circuit structure of a level shift circuit and latch circuit. In this drawing, one end of a switch 32 is connected to a digital data line 31 and to the other end of the switch 32 the one ends of a switch 33 and capacitor 34 are connected respectively. The other end of the switch 33 is connected to a reference voltage line 35. A reference voltage Vref of the reference voltage line 35 is set to a voltage around (VH−VL)/2 wherein VH and VL stand for "H" level and "L" level of a digital data.

An input terminal of an inverter 36, each one end of switches 37 and 38 are connected to the other end of the capacitor 34. The other end of the switch 37, input terminal of an inverter 39 are connected to the inverter 35. The other end of the switch 38 is connected to the output terminal of the inverter 39. In other words, the switch 37 is connected to the inverter 36 in parallel, and the switch 38 is connected in parallel to inverters 36 and 39 which are two step cascade connected.

In the above-mentioned circuit structure, respective shift circuits 15-1 to **15-*n* comprise the switch 33, capacitor 34, inverter 36, and switch 37, and respective latch circuit 16-1 to 16-*n* comprise the two step cascade connected inverters 36 and 39, and switch 38. The switch 32, switches 33 and 37, and switch 38** are on-off controlled in response to the sampling pulse, equalizing pulse, and latch pulse respectively.

The sampling pulse and equalizing pulse are equivalent to the sampling pulse and level shift pulse generated by the H shift register 11. The latch pulse is generated by the H shift register 11. As described herein above, the H shift register 11 for generating the horizontal scanning sampling pulse is served commonly as the pulse generation circuit for generating various pulse such as the level shift pulse and latch pulse, thereby the circuit structure of a whole system is simplified advantageously in comparison with use of exclusively used separate pulse generation circuits.

Figure 3:
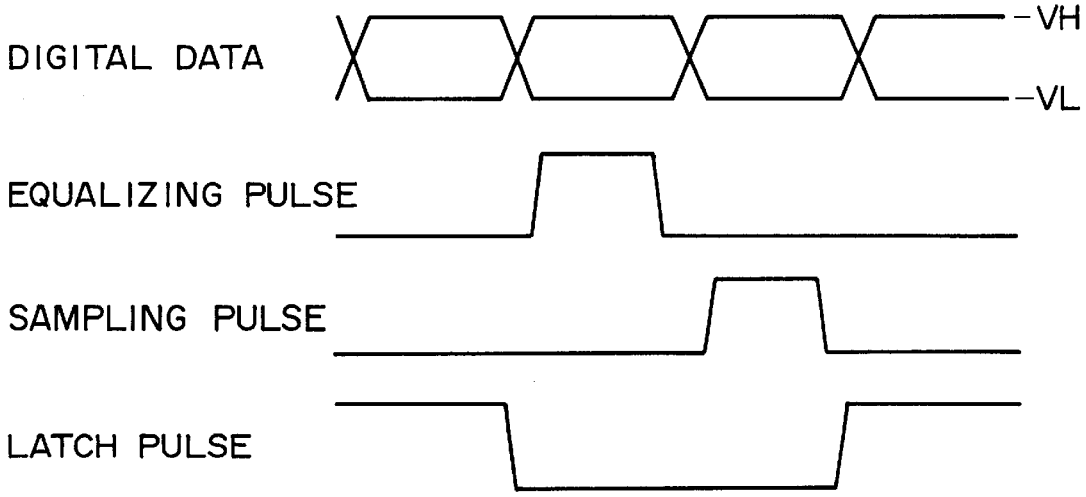
FIG. 3 is a timing waveform diagram for describing the operation of the circuit shown in FIG. 2.

Next, circuit operation of the level shift circuit and latch circuit having the structure described herein above is described with reference to timing wave form diagrams shown in FIG. 3.

First, in a data period immediately antecedent to a data period ("H" level period of sampling pulse) in which sampling is actually performed, an equalizing pulse is changed to "H" level to turn on the switch 33. The capacitor 34 is thereby charged with the reference voltage Vref. The reference voltage Vref is served as a reference voltage for determining the level of digital data to be supplied next. When, the switch 37 is turned on simultaneously to connect input/output terminals of the front end inverter 36, and the operation point is set to a value around intermediate voltage.

The equalizing pulse is changed to "L" level, then the sampling pulse is changed to "H" level, the switch 32 is turned on, the digital data is thereby sampled. When, it is determined whether the level of the supplied digital data is higher or lower than the reference voltage Vref is, if the digital data is higher, then the output level of the inverter 36 is changed to 0 V. On the other hand, if the digital data is lower, then the output level of the inverter 36 is changed to the power voltage Vd (for example 12 V) of the horizontal driving circuit system.

Then, the sampling pulse is changed to "L" level, the larch pulse is changed to "H" level. Hence, the switch 38 is turned on, and the front end inverter 36 and rear end inverter 39 are loop connected through the switch 38 to structure a latch circuit. As the result, the sampled digital data is held for one horizontal period as the output level of the inverter 39 in the condition that the level of the sampled digital data is shifted to the power source voltage Vd.

As described herein above, by providing level sift circuits 15-1 to **15-*n* between sampling switches 12-1 to 12-*n* and latch circuits 16-1 to 16-*n*, the sampled digital signal having a small amplitude (VH−VL) is amplified rapidly to a digital signal of 0 V to the power source voltage Vd (for example 12 V) namely a digital signal having a signal level required to process in latch circuits 16-1 to 16-*n*** and subsequent circuits.

Figure 4:
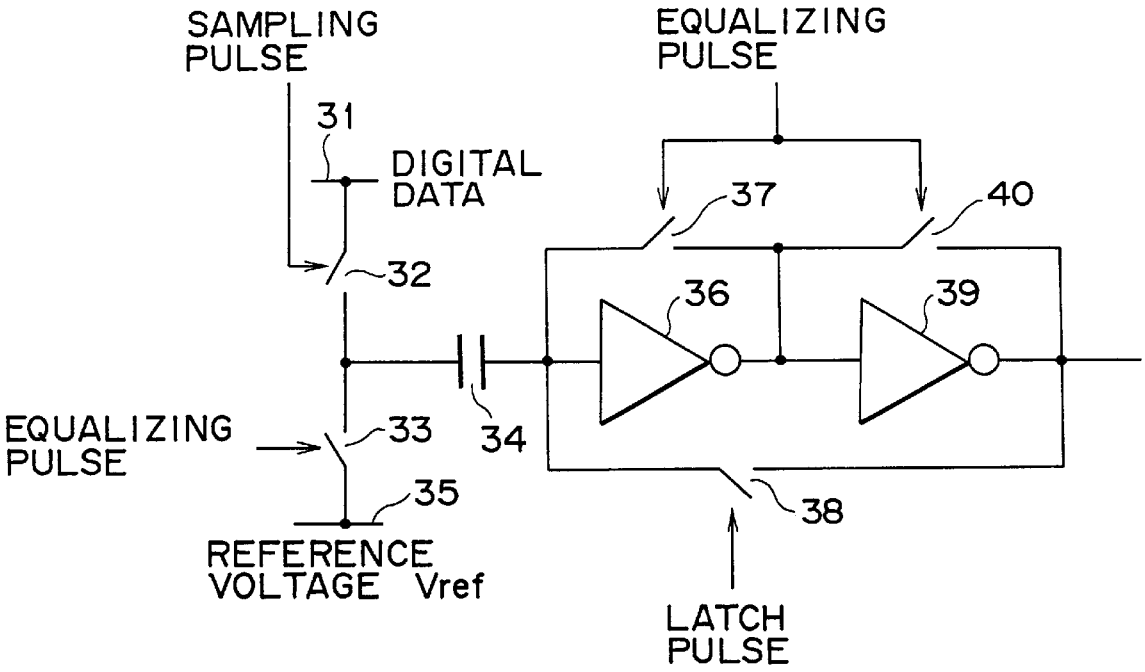
FIG. 4 is a circuit diagram for illustrating a modified example of a level shift circuit and a latch circuit.
Figure 6:
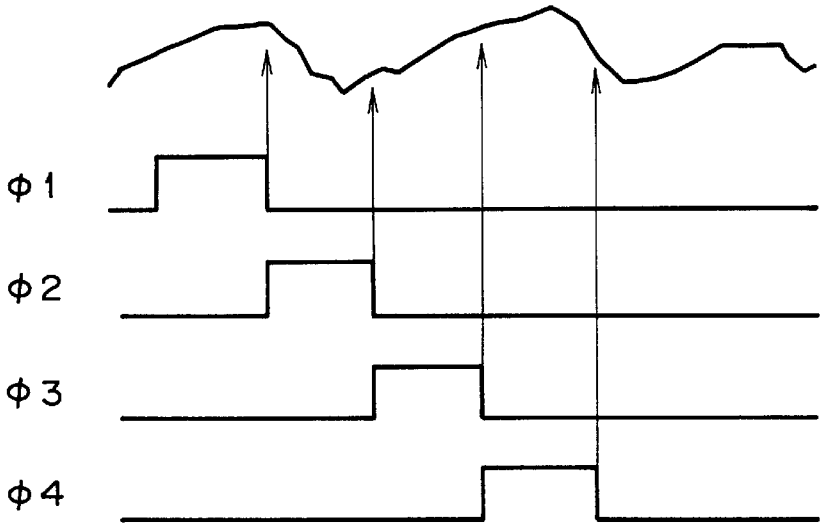
FIG. 6 is a timing waveform diagram in accordance with the conventional example.
Figure 5:
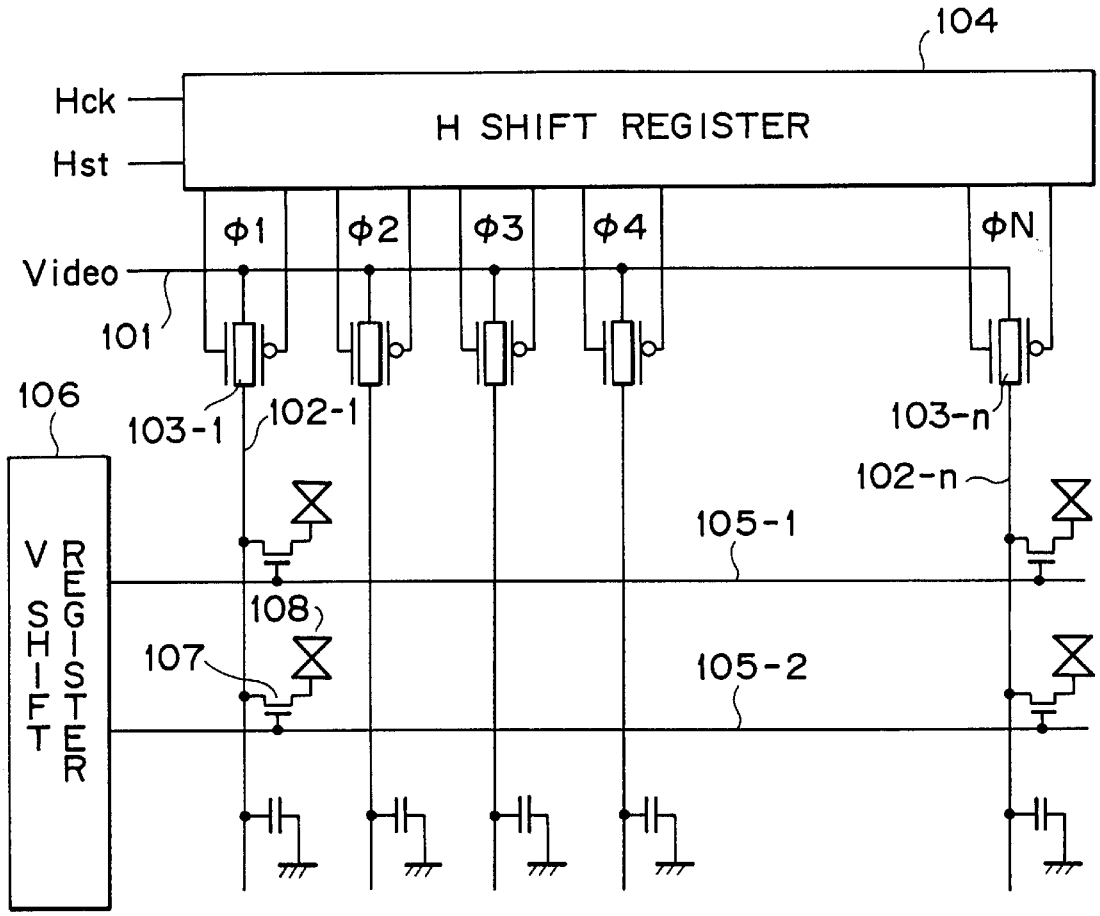
FIG. 5 is a schematic structural diagram for illustrating a conventional example.

It is possible thereby to supply a digital signal having a small amplitude from the outside. By rendering the circuit structure acceptable to digital input, the interface to a personal computer is simplified. A level shift circuit and latch circuit having a circuit structure as shown in FIG. 4 may be used. In detail, in this modified example, an inverter 39 and switch 40 are connected in parallel. The circuit structure in which the switch 40 is on-off controlled in response to an equalizing pulse together with a switch 37 is realized, and this circuit structure functions like the above-mentioned circuit structure.

In the above-mentioned embodiment, the case of the circuit structure in which the level shift circuits 15-1 to **15-*n* for shifting the level of the sampled digital signal to 0 V to the power source voltage Vd as a level conversion means are used is described. However, alternatively, the level conversion means is by no means limited to the case, and other structures may be used as long as the structure performs level conversion or amplification of the sampled digital signal to a signal having a signal level sufficient for processing in latch circuits 16-1 to 16-*n*** and subsequent circuits.

According to the present invention as described hereinbefore, by providing a means for converting the level of a sampled digital signal to a signal having a signal level sufficient for subsequent processing in a driving circuit unit and by forming the driving circuit unit and pixel unit combinedly, the combined system is rendered capable of accepting a digital signal input having a small signal amplitude from the outside, and thus the interface with a personal computer is simplified. Further, because a process for mounting a dedicated IC such as TAB used conventionally is unnecessary, the cost is reduced and the number of connection terminals is significantly reduced, and the reliability of mounting is greatly improved.

What is claimed is:

1. A liquid crystal display device having a driving circuit unit and a pixel unit formed combinedly which is capable of accepting a digital signal input having a signal level lower than a power source voltage level of a horizontal driving circuit system, comprising:

pulse generation means for generating a sampling pulse which samples in time series an input digital signal correspondingly to a pixel;

sampling means for sampling said input digital signal in response to said sampling pulse;

level conversion means for converting a digital signal sampled by said sampling means to a signal having a signal level sufficient for subsequent processing;

latch means for means for holding a digital signal converted by said level conversion means, wherein said level conversion means and said latch means comprise a first switch that is connected to a digital data line, a second switch that is connected to said first switch and to a reference voltage, a capacitor that is connected to a connection middle point of said first switch and said second switch, a first inverter connected to the other end of said capacitor, a third switch provided between an input and output of said first inverter and controlled by said level shift pulse, a second inverter connected to the output of said first inverter, and a fourth switch connected in parallel to said first inverter and said second inverter and controlled by a latch pulse; and D/A conversion means for generating an analog signal based on a digital signal which was level converted by said level conversion means.

2. The liquid crystal display device as claimed in claim 1, wherein said latch means holds a digital signal during one horizontal period.

3. The liquid crystal display device as claimed in claim 2, wherein said level conversion means and said latch means comprise a first switch that is connected to a digital data line, a second switch that is connected to said first switch and to a reference voltage, a capacitor that is connected to a connection middle point of said first switch and said second switch, a first inverter connected to said capacitor, a third switch provided between an input and output of said first inverter and controlled by said level shift pulse, a second inverter connected to the output of said first inverter, and a fourth switch connected in parallel to said first inverter and said second inverter and controlled by a latch pulse.

4. The liquid crystal display device as claimed in claim 3, wherein said level conversion means and said latch means further comprise a fifth switch provided between input and output of said second inverter and controlled by said level shift pulse additionally.

5. The liquid crystal display device as claimed in claim 3, wherein said reference voltage has an electric potential of approximately (VH−VL)/2, in which VH stands for the high level of a input digital data and VL stands for the low level of the input digital data.

6. The liquid crystal display device as claimed in claim 4, wherein said reference voltage has an electric potential of approximately (VH−VL)/2, in which VH stands for the high level of input digital data and VL stands for the low level of the input digital data.

7. The liquid crystal display device as claimed in claim 1, wherein said level conversion means and said latch means further comprise a fifth switch provided between input and output of said second inverter and controlled by said level shift pulse additionally.

8. The liquid crystal display device as claimed in claim 7, wherein said reference voltage has an electric potential of approximately (VH−VL)/2, in which VH stands for the high level of input digital data and VL stands for the low level of the input digital data.

9. The liquid crystal display device as claimed in claim 1, wherein said reference voltage has an electric potential of approximately (VH−VL)/2, in which VH stands for the high level of input digital data and the VL stands for the low level of the input digital data.

10. The liquid crystal display device as claimed in claim 1, wherein said level conversion means is a level shift circuit for shifting the level of the digital signal sampled by said sampling means to the power voltage level of said horizontal driving device.

11. The liquid crystal display device as claimed in claim 10, wherein said pulse generation means is a horizontal scanning circuit and generates also a level shift pulse to be supplied to said level shift circuit.

12. The liquid crystal display device as claimed in claim 1, wherein said sampling means is a switch element provided correspondingly to a column line.

* * * * *

UNITED STATES PATENT AND TRADEMARK OFFICE

CERTIFICATE OF CORRECTION

PATENT NO. : 6,256,024 B1
DATED : July 3, 2001
INVENTOR(S) : Toshikazu Maekawa

It is certified that error appears in the above-identified patent and that said Letters Patent is hereby corrected as shown below:

Column 6,
Line 27, delete the word "a".

Signed and Sealed this

Twenty-first Day of May, 2002

*Attest:*

*Attesting Officer*

JAMES E. ROGAN
*Director of the United States Patent and Trademark Office*